US010839744B2

(12) United States Patent
Li et al.

(10) Patent No.: US 10,839,744 B2
(45) Date of Patent: Nov. 17, 2020

(54) STRETCH DISPLAY SCREEN AND DISPLAY DEVICE

(71) Applicant: Yungu (Gu'an) Technology Co., Ltd., Langfang (CN)

(72) Inventors: Jin Li, Langfang (CN); Fengzhi Yu, Langfang (CN); Weijie Gu, Langfang (CN); Xiaojia Liu, Langfang (CN); Chuang Chen, Langfang (CN)

(73) Assignee: YUNGU (GU'AN) TECHNOLOGY CO., LTD., Langfang (CN)

( * ) Notice: Subject to any disclaimer, the term of this patent is extended or adjusted under 35 U.S.C. 154(b) by 0 days.

(21) Appl. No.: 16/691,844

(22) Filed: Nov. 22, 2019

(65) Prior Publication Data

US 2020/0193899 A1 Jun. 18, 2020

Related U.S. Application Data

(63) Continuation of application No. PCT/CN2019/071586, filed on Jan. 14, 2019.

(30) Foreign Application Priority Data

Jun. 13, 2018 (CN) ..... 2018 2 0917083 U

(51) Int. Cl.
*G09G 3/3208* (2016.01)

(52) U.S. Cl.
CPC ..... *G09G 3/3208* (2013.01); *G09G 2320/02* (2013.01); *G09G 2380/02* (2013.01)

(58) Field of Classification Search
CPC ..... G09G 2380/02; G09G 2300/0465; G09G 3/3208; G09G 2320/02; G09G 3/20;
(Continued)

(56) References Cited

U.S. PATENT DOCUMENTS

2009/0121983 A1* 5/2009 Sung ..... H01L 27/3216 345/76
2016/0124536 A1* 5/2016 Hyun ..... G06F 1/1626 345/173
(Continued)

FOREIGN PATENT DOCUMENTS

CN 103578359 A 2/2014
CN 104375302 A 2/2015
(Continued)

OTHER PUBLICATIONS

CN 208189154 U _ English Translation.
(Continued)

*Primary Examiner* — Temesghen Ghebretinsae
*Assistant Examiner* — Ivelisse Martinez Quiles
(74) *Attorney, Agent, or Firm* — Ladas & Parry LLP

(57) ABSTRACT

A stretch display screen includes: a display region including a sub-display region and a pixel compensation region which are arranged in a predetermined direction in sequence, and a stretching region; a detecting unit disposed in the stretching region for sensing a tensile strength of the stretch display screen; and a pixel compensation control unit configured to receive a signal of the detecting unit and control a corresponding pixel compensation region to emit light according to the tensile strength.

14 Claims, 4 Drawing Sheets

(58) Field of Classification Search
CPC ... G09G 2320/0233; G09G 2320/0242; G09G 3/2003; G09F 9/03; G09F 9/33
See application file for complete search history.

(56) References Cited

U.S. PATENT DOCUMENTS

| | | | | |
|---|---|---|---|---|
| 2016/0198567 | A1* | 7/2016 | Hong | G06F 3/0412 362/418 |
| 2017/0124940 | A1* | 5/2017 | Hsu | G09G 3/3208 |
| 2017/0294610 | A1* | 10/2017 | Sasaki | H01L 27/3276 |
| 2018/0013092 | A1* | 1/2018 | Park | H01L 51/0097 |
| 2020/0143729 | A1* | 5/2020 | Xu | G09G 3/2007 |
| 2020/0184856 | A1* | 6/2020 | Wang | H01L 27/3248 |

FOREIGN PATENT DOCUMENTS

| | | | |
|---|---|---|---|
| CN | 106910842 | A | 6/2017 |
| CN | 107731866 | A | 2/2018 |
| CN | 108122488 | A | 6/2018 |
| CN | 208189154 | U | 12/2018 |
| KR | 20160088523 | A | 7/2016 |
| KR | 20160130062 | A | 11/2016 |

OTHER PUBLICATIONS

CN 106910842 A _ English Translation.
CN 104375302 A _ English Translation.
CN 108122488 A _ English Translation.
KR 20160130062 A _ English Translation.
KR 20160088523 A _ English Translation.
CN 107731866 A _ English Translation.
CN 103578359 A _ English Translation.

* cited by examiner

STRETCH DISPLAY SCREEN AND DISPLAY DEVICE

CROSS-REFERENCE TO ASSOCIATED APPLICATIONS

This application is a continuation of International Application No. PCT/CN2019/071586 filed on Jan. 14, 2019, which claims priority to Chinese patent application No. 201820917083.4 filed on Jun. 13, 2018. Both applications are incorporated herein by reference in their entireties.

TECHNICAL FIELD

Embodiments of the present application relate to the field of display screen technologies, in particular to a stretch display screen and a display device.

BACKGROUND

In recent years, with the rapid development of display technologies, display screens have been gradually applied to various industries. Due to the limitations of some specific fields, for example, in the field of wearable display screens, rigid display screens can no longer meet the display requirements, and in this situation, stretch display screens came into being. However, the existing stretch display screens often cause problems of display distortion and resolution reduction after being stretched by force.

SUMMARY

In view of this, embodiments of the present application are directed to providing a stretch display screen to solve problems of image distortion and resolution reduction after stretching the existing stretch display screen.

According to one aspect of the present application, a stretch display screen is provided which includes; a display region including at least one sub-display region, at least one pixel compensation region which are arranged in a predetermined direction in sequence, and a stretching region; a detecting unit disposed in the stretching region for acquiring a tensile strength of the stretch display screen in a stretched state; and a pixel compensation control unit configured to receiving a signal of the detecting unit and controlling a light-emitting area of the at least one pixel compensation region to emit light according to the tensile strength.

Preferably, in the stretched state, the tensile strength of the stretch display screen matches with a light-emitting area of the at least one pixel compensation region, and the greater the tensile strength is, the larger the light-emitting area of the at least one pixel compensation region is.

Preferably, the detecting unit is an elastic sensor, and the pixel compensation control unit is a controller.

Preferably, the at least one sub-display region and the at least one pixel compensation region are independently controlled.

Preferably, the at least one pixel compensation region includes a plurality of pixel compensation regions disposed radially around the at least one sub-display region, each of the plurality of pixel compensation regions includes a plurality of compensation pixel units, and the greater the tensile strength of the stretch display screen is, the more the compensation pixel units that are radially outwardly distributed from the sub-display region emit light is.

Preferably, a ratio of a sum of a light-emitting area of the at least one pixel compensation region to a sum of a light-emitting area of the at least one sub-display region is greater than 0 and less than or equal to 0.5.

Preferably, each of the at least one sub-display region and each of the at least one pixel compensation region respectively include at least one pixel unit, each of the at least one pixel unit includes three sub-pixels of different colors, and an area of an opening of the sub-pixel in the sub-display region is same to that of the sub-pixel of a same color in the pixel compensation region.

Preferably, the three sub-pixels in each of the at least one pixel unit in the sub-display region are arranged in an isosceles triangle, and a vertical bisector of the isosceles triangle is parallel to the predetermined direction.

Preferably, the stretching region extends through a substrate, a Thin Film Transistor (TFT) layer and an Organic Light-Emitting Diode (OLED) layer of the stretch display screen in a direction orthogonal to the stretch display screen.

Preferably, each of the at least one sub-display region and each of the at least one pixel compensation region have same layer structures.

Preferably, the stretching region includes a stress relief module, and each layer in the stress relief module corresponds to each layer in each of the at least one sub-display region and each of the at least one pixel compensation region one by one.

Preferably, each layer of the stretching region is made of a shape memory polymer.

Preferably, the shape memory polymer is a styrene or an epoxy polymer.

Preferably, each of the at least one sub-display region includes at least one predetermined pixel unit, each of the at least one pixel compensation region includes a compensation at least one pixel unit located on one side of each of the at least one predetermined pixel unit deviating from a stretching direction of the stretch display screen, and a distance d between each of the at least one compensation pixel unit and the predetermined pixel unit is equal to $$\frac{L}{L+D} \times D,$$

L refers to a stretched length of the stretch display screen, and D refers to a spacing of two predetermined pixel units on both sides of the compensation pixel unit in a stretching direction of the stretch display screen.

Preferably, each of the at least one pixel compensation region includes a plurality of compensation pixel units, the plurality of compensation pixel units are linearly arranged along the predetermined direction; the at least one sub-display region and the at least one pixel compensation region are independently controlled, and the greater the tensile strength of stretch display screen is, one of the plurality of compensation pixel units which is further away from a corresponding predetermined pixel unit is selected to emit light instead of the corresponding predetermined pixel unit. In another word, the selected compensation pixel unit emits light, while the predetermined pixel unit doesn't emit light.

According to another aspect of the present application, a display device is provided which includes the above-described stretch display screen.

According to the stretch display screen and the display device provided by the present application, when the detecting, unit detects that an elastic region is distorted, the pixel compensation control unit can trigger the pixel compensation region to light up accordingly according to an actual situation to ensure that pixel density remains unchanged before and after stretching the display screen, thereby ensuring that the display screen does not distort due to stretching.

DETAILED DESCRIPTION

In order to make the purposes, technical means and advantages of the present implication more clear, the present implication will be further described in detail below with reference to the accompanying drawings.

Figure 1A:
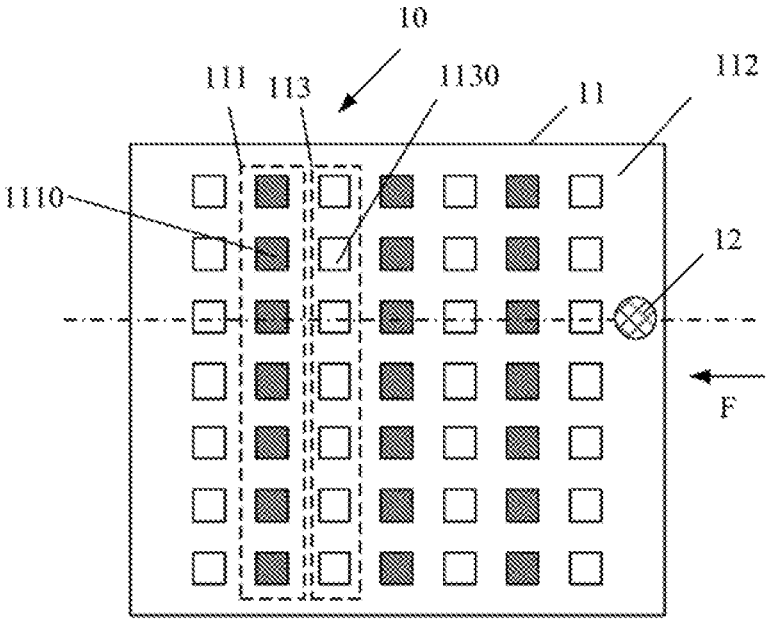
FIG. 1*a* is a schematic structural diagram of a stretch display screen according to the present application.

FIG. 1*a* is a schematic structural diagram of a stretch display screen according to an embodiment of the present application. As may be seen in FIG. 1*a*, the stretch display screen 10 includes a display region 11, a detecting unit 12 and a pixel compensation control unit (not shown in FIG. 1*a* or FIG. 1*b*). The display region 11 includes at least one sub-display region 111 and at least one pixel compensation region 113 which are arranged in a predetermined direction in sequence, and a stretching region 112 other than the sub-display region 111 and the pixel compensation region 113. The detecting unit 12 is disposed in the stretching region 112 for acquiring a tensile strength of the stretch display screen in a stretched state, and the pixel compensation control unit is configured to receive a signal of the detecting unit 12 and control a light-emitting area of the at least one pixel compensation region 113 to emit light according to the tensile strength.

The pixel compensation region 113 and the sub-display region 111 may include at least one pixel unit. For example, as shown in FIG. 1*a*, the pixel compensation region 113 and the sub-display region 111 respectively include a plurality of pixel units, each small square in FIG. 1*a* represents one pixel unit.

A ratio of a sum of a light-emitting area of the at least one pixel compensation region 113 to a sum of a light-emitting area of the at least one sub-display region is greater than 0, and less than or equal to 0.5.

In the stretch display screen 10, the at least one pixel compensation region 113 and the at least one sub-display region 111 may be independently controlled. Specifically, when the stretch display screen 10 is in an non-stretched state, a controller controls the at least one sub-display region 111 to display. When the stretch display screen 10 is stretched, the pixel compensation control unit controls the at least one pixel compensation region 113 to light up to display together with the at least one sub-display region 111, and the distortion of the sub-display region 111 is balanced by the number of pixel units added by the at least one pixel compensation region 113 to ensure that the pixel density of the stretch display screen 10 remains unchanged before and after stretching, thereby avoiding the display distortion.

Figure 1B:
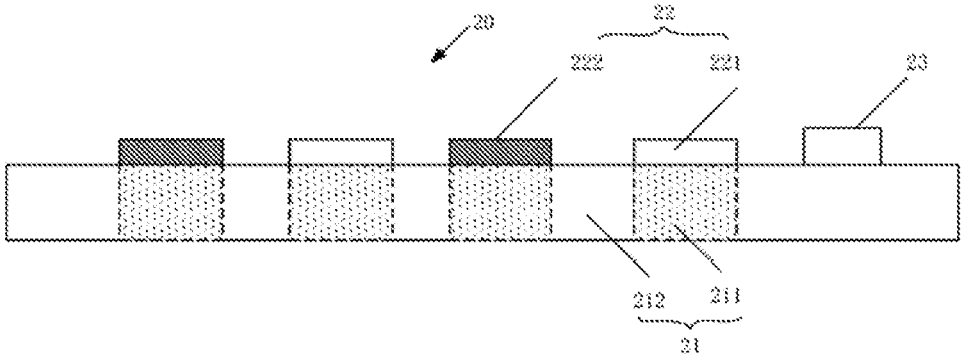
FIG. 1*b* is a partial cross-sectional schematic structural diagram of the stretch display screen of an embodiment of the present application.

FIG. 1*b* is a partial cross-sectional schematic structural diagram of the stretch display screen of an embodiment similar to that shown in FIG. 1*a*, when the stretch display screen includes a substrate. As may be seen in FIG. 1*b*, the stretch display screen 20 includes the substrate 21, a display layer 22, and a detecting unit 23. The substrate 21 includes a rigid region 211 and a stretching region 212. The display layer 22 is disposed in the rigid region 211 and includes a plurality of sub-display regions 221 and a plurality of pixel compensation regions 222 disposed around the plurality of sub-display regions 221. The detecting unit 23 is disposed on the stretching region 212 for detecting the distortion of the stretching region 212, and the pixel compensation control unit triggers partial or full light of the plurality of pixel compensation regions 222 according to a size of a deformation. The greater the tensile strength of the stretch display screen is, the larger the light-emitting area of the at least one pixel compensation region is. In the stretched state, the tensile strength of the stretch display screen matches which the light-emitting area of the at least one pixel compensation region 222.

The detecting unit may be an elastic sensor, the pixel compensation control unit is a controller. The controller configured to control the at least one pixel compensation region 222 and the controller configured to control the at least one sub-display region 221 may share the same one or may be separately set.

Figure 1C:
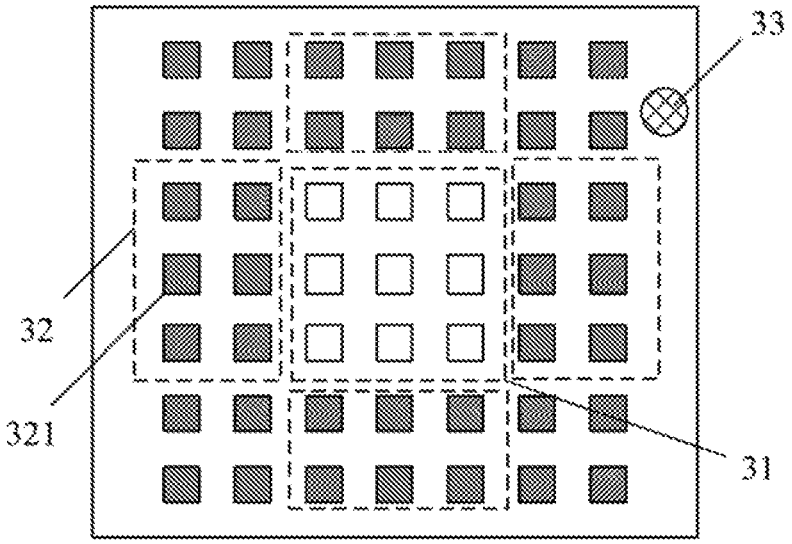
FIG. 1*c* is a schematic structural diagram of a stretch display screen according to another embodiment of the present application.

FIG. 1*c* is a schematic structural diagram of a stretch display screen according to another embodiment of the present application. As may be seen from FIG. 1*c*, the at least one pixel compensation region includes a plurality of pixel compensation regions 32 disposed radially around each of the at least one a sub-display region 31 in the stretch display screen, and each of the plurality of pixel compensation regions 32 includes a plurality of compensation pixel units 321. The stretch display screen has a plurality of stretching directions, such as a wearable display screen, when the detecting unit 33 detects that the stretching region is distorted along the plurality of stretching directions, the pixel compensation control unit triggers a corresponding amount of compensation pixel units to light up according to the tensile strength. The greater the tensile strength of the stretch display screen is, one of the plurality of the compensation pixel units 321 which is further away from a corresponding predetermined pixel unit is selected to emit light to replace the corresponding predetermined pixel unit.

Figure 1D:
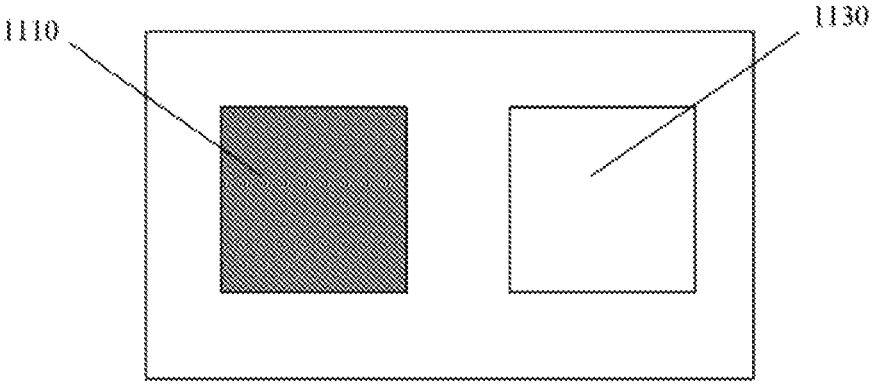
FIG. 1*d* is an enlarged view of a repeating unit in the stretch display screen of FIG. 1*a*.

FIG. 1*d* is an enlarged view of a repeating unit in the stretch display screen of FIG. 1*a*. As may be seen from FIG. 1*a* and FIG. 1*d*, each of the at least one pixel compensation region 113 includes a plurality of compensation pixel units 1130, and each of the at least one sub-display region 111 includes a plurality of predetermined pixel units 1110 located on one side of each of the at least one predetermined pixel unit 1110 deviating from a stretching direction F of the stretch display screen 10. For example, one compensation pixel unit 1130 and one predetermined pixel unit 1110 make up a repeating unit in the stretch display screen of FIG. 1*a*. The stretching direction F shown in FIG. 1*a* is horizontally left, and the compensation pixel unit 1130 in a rectangular frame is located on a right side of the predetermined pixel unit 1110. A distance d between the compensation pixel unit 1130 and the predetermined pixel unit 1110 depends on a spacing D of the predetermined pixel units 1110 on both sides of the compensation pixel unit 1130 in the stretching, direction of the stretch display screen and a stretched length L of the stretch display screen 10. Specifically, the distance d between each of the at least one compensation pixel unit 1130 and the corresponding predetermined pixel unit 1110 is equal to $$\frac{L}{L+D} \times D.$$

The predetermined pixel unit 1110 refers to a pixel for image display in which the stretch display screen 10 is in an un-stretched state, and the compensation pixel unit 1130 refers to a pixel positioned in the predetermined pixel unit position for performing the image display instead of the predetermined pixel unit 1110 when the stretch display screen 10 is in the stretched state. In this case, the predetermined pixel unit 1110 and the compensation pixel unit 1130 have the same opening area. A shape of the predetermined pixel unit 1110 and the compensation pixel unit 1130 may be the same or different, for example, may respectively include any one of a circle, a rectangle, and a sector, which is not limited in the present application.

According to the stretch display screen provided by the present embodiment, by providing the compensation pixel unit 1130 for the predetermined pixel unit 1110, on the one hand, the display distortion after stretching can be avoided, and on the other hand, the pixel density reduction can be avoided.

The principles of the stretch display screen provided by the present application to avoid the display distortion and the pixel density reduction after stretching will be specifically described below with reference to the accompanying drawings.

Figure 2:
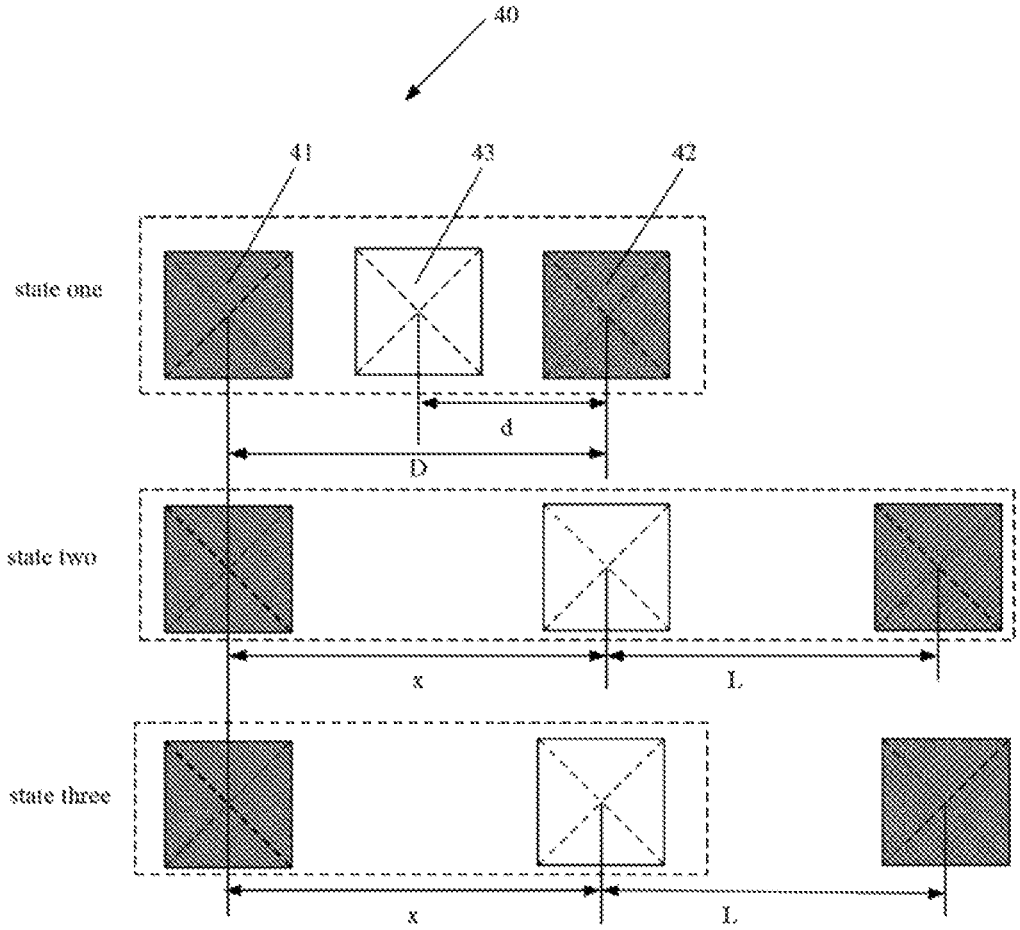
FIG. 2 is a schematic diagram showing a display effect of three working states of the repeating unit of FIG. 1*d* according to an embodiment of the present application.

FIG. 2 is a schematic dial; ram showing a display effect of three working states of the repeating unit of FIG. 1*d* according to an embodiment of the present application. Referring to state one, the stretch display screen 40 performs image display by a first predetermined pixel unit 41 and a second predetermined pixel unit 42 in an un-stretched state, and a display pattern is as shown by a rectangular frame in FIG. 2. A distance between the first predetermined pixel unit 41 and the second predetermined pixel unit 42 is D, and the distance between the compensation pixel unit 43 and the second predetermined pixel unit 42 is d.

Referring to state two, when a pulling force is horizontally rightward applied to the stretch display screen 40, a horizontal stretched length of the stretch display screen 40 in a direction of the pulling force is L. In this case, when the second predetermined pixel unit 42 and the first predetermined pixel unit 41 are still used for performing the image display, and a display image is shown as the rectangular frame, the image display will be distorted, and the pixel density will be lowered since a space between the pixels is increased.

Referring to state three, in the case of the state two, since a ratio of the spacing between the compensation pixel unit 43 and the first predetermined pixel unit 41 to the spacing between the compensation pixel unit 43 and the second predetermined pixel unit 42 should remain unchanged before and after stretching, i.e., $$\frac{D-d}{d} = \frac{x}{D+L-x},$$

x refers to a distance between the compensation pixel unit 43 which is stretched and the first predetermined pixel unit 41.

When $$\frac{D-d}{d} = \frac{x}{D+L-x}$$

is combined with $$d = \frac{L}{L+D} \times D,\ x = D$$

can be obtained.

It may be seen that, after the stretch display screen provided by the present application is stretched, the compensation pixel unit 43 is just in a position of the second predetermined pixel unit 42 before stretching. At this time, the compensation pixel unit 43 is used instead of the second predetermined pixel unit 42 to cooperate with the first predetermined pixel unit 41 for the image display. The display image is as shown in the rectangular frame, which is equivalent to the spacing between display pixels and the number of display pixels unchanged before and after stretching, so that on the one hand, the display distortion after stretching may be avoided, and on the other hand, the pixel density reduction may be avoided.

Figure 3:
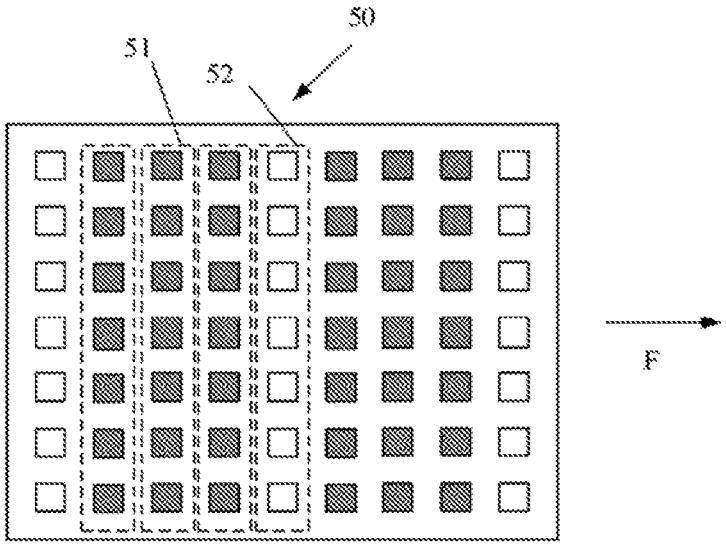
FIG. 3 is a schematic structural diagram of a stretch display screen including a plurality of pixel compensation regions.

As may be seen from FIG. 3, the difference between a stretch display screen 50 and the stretch display screen 10 shown in FIG. 1*a* is only that the stretch display screen 50 includes a plurality of pixel compensation regions 51, for example, the stretch display screen 50 includes three pixel compensation regions as shown in FIG. 3. The plurality of pixel compensation regions 51 are linearly arranged along a stretching direction F of the stretch display screen 50. In this case, the spacing between the plurality of pixel compensation regions 51 may be equal or unequal.

According to the stretch display screen provided by the embodiment, by providing the plurality of pixel compensation regions 51, the pixel compensation region 51 in a corresponding position may be appropriately selected to replace a sub-display region 52 according to a stretched length of the stretch display screen 50, thereby expanding a stretchable range of the stretch display screen 50.

Figure 4:
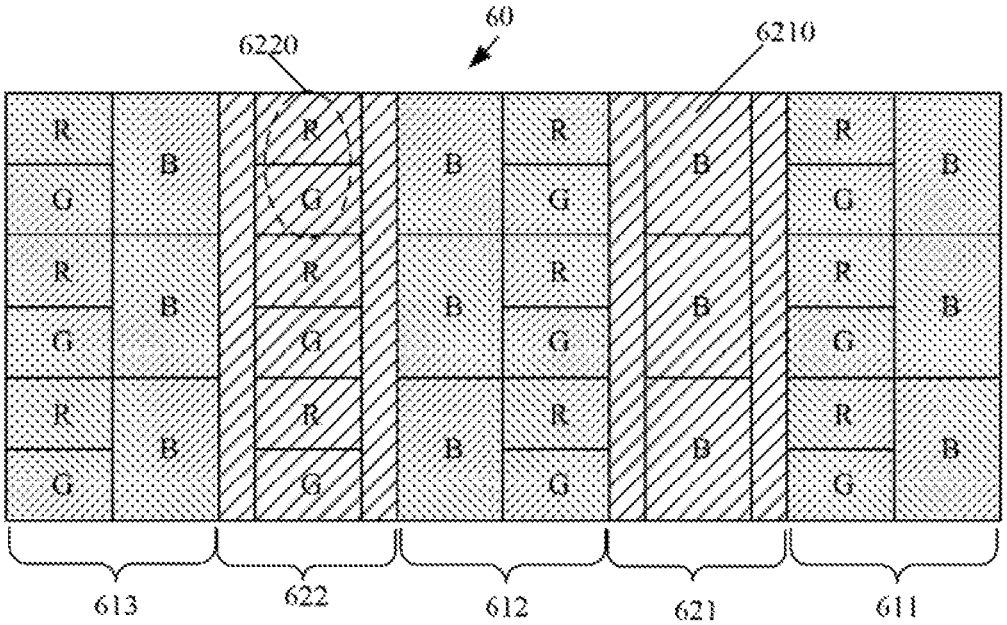
FIG. 4 is a schematic diagram showing an arrangement of sub-pixels of a stretch display screen according to the embodiment of the present application.

FIG. 4 is a schematic diagram showing an arrangement of sub-pixels of a stretch display screen according to an embodiment of the present application. As may be seen from FIG. 4, each of the at least one sub-display region and each of the at least one pixel compensation region in a stretch display screen 60 respectively include at least one pixel unit, each of the at least one pixel unit includes three sub-pixels of different colors. An area of an opening of the sub-pixel in each of the sub-display region is same to that of the sub-pixel of a same color in each of the pixel compensation region.

Specifically, a first sub-display region 611, a second sub-display region 612, and a third sub-display region 613 respectively include three predetermined pixel units. Each of the three predetermined pixel units includes three sub-pixels, which is respectively displaying R, G, and B. Although the sub-pixels in three sub-display regions display the same color, an arrangement manner of the sub-pixels is not necessarily the same. In this case, the color and the arrangement manner of the sub-pixels in the pixel compensation region which is adjacent to the sub-display region may be reasonably set according to the arrangement manner of the sub-pixels in the sub-display region.

For example, as shown in FIG. 4, the first pixel compensation region 621 between the first sub-display region 611 and the second sub-display region 612 includes a compensation sub-pixel 6210 which is only displaying B, and the compensation sub-pixel 6210 which is only displaying B and the sub-pixels displaying R and G which is adjacent to the compensation sub-pixel 6210 constitute a three primary color. The second pixel compensation region 622 between the second sub-display region 612 and the third sub-display region 613 includes a compensation sub-pixel 6220 which is displaying R and G, and the conventional sub-pixels displaying B which is adjacent to the compensation sub-pixel 6220 constitute the three primary color.

In one embodiment, the three sub-pixels in each of the pixel units in the sub-display region are arranged in an isosceles triangle, and a vertical bisector of the isosceles triangle is parallel to the stretching direction (i.e., the predetermined direction). In this case, a control process of the stretch display screen 60 may be, for example, when the stretch display screen 60 is not stretched, a control unit may control the sub-pixels displaying R, G, and B in the first sub-display region 611 to display a second color, such as light blue and control the sub-pixels displaying R, G, and B in the second sub-display region 612 to display a third color, such as dark blue. When the stretch display screen 60 is stretched, the control unit may control the compensation sub-pixel 6210 displaying B and the sub-pixels displaying R and G in the first sub-display region 611 to display the second color, i.e., light blue. Optionally, control unit may control the compensation sub-pixel 6210 displaying B and the sub-pixels displaying R and G in the second sub-display region 612 to display the third color, i.e., dark blue, or control the compensation sub-pixel 6210 displaying B and the sub-pixels displaying R and G in the first sub-display region 611 and the second sub-display region 612 display the second color and the third color, i.e., the light blue and the dark blue.

According to the stretch display screen provided by the embodiment, the sub-pixels may be only set with some colors in the pixel compensation region, instead of setting the pixel units with three colors. It simplifies a technological process of the stretch display screen in a production process and reduces the production cost. At the same time, it enhances the image display quality when the stretch display screen is stretched, for ensuring the consistency of the display quality before and after stretching the stretch display screen.

Figure 5:
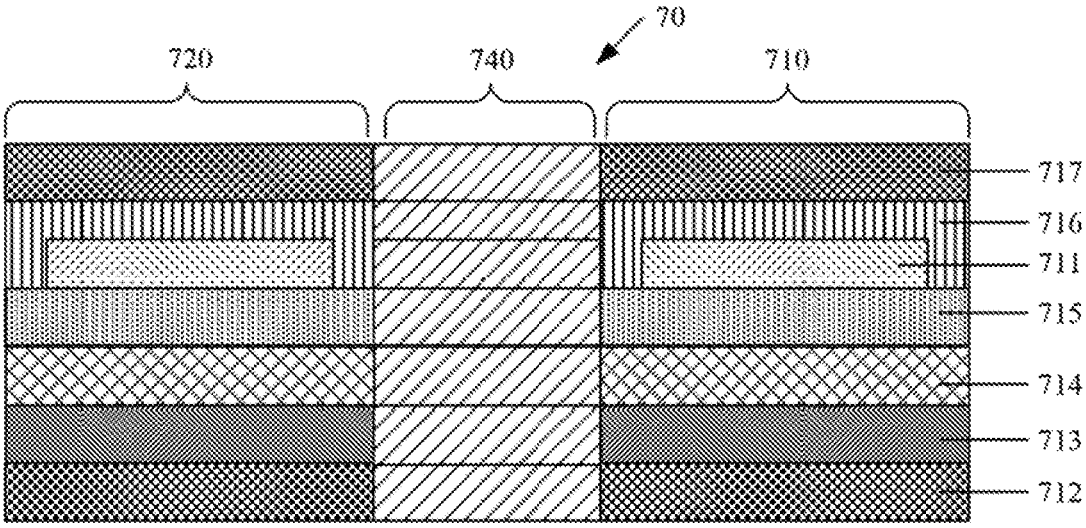
FIG. 5 is a cross-sectional view of a stretch display screen according to the embodiment of the present application.

FIG. 5 is a cross-sectional view of a stretch display screen according to an embodiment of the present application. As may be seen from FIG. 5, a stretch display screen 70 includes a stretching region 740 that extends through a substrate, a TFT layer, and an OLED layer of the stretch display screen 70 in a direction orthogonal to the stretch display screen 70.

Specifically, as shown in FIG. 5, the stretch display screen 70 includes a sub-display region 710, a pixel compensation region 720 and the stretching region 740. The sub-display region 710 and the pixel compensation region 720 have same film structures. Taking the sub-display region 710 as an example, the sub-display region 710 includes a flexible organic layer 712, a flexible substrate 713, a barrier layer 714, a TFT layer 715, an OLED layer 711, an encapsulation layer 716, and a flexible stretch organic layer 717 which are stacked in sequence. It may prevent water vapor or oxygen from on the TFT layer 715 and slow down the aging of the TFT layer 715, thereby increasing the life of the TFT layer 715. The flexible substrate 713 may absorb part of the stress when the stretch display screen 70 is stretched, so that a base layer is more easily stretched.

The stretching region 740 is disposed between the sub-display region 710 and the pixel compensation region 720 and includes a stress relief module. Each layer in the stress relief module corresponds to each layer in the sub-display region 710 and the pixel compensation region 720 one by one. Each layer in the stress relief module may be referred to a stress relief layer. For example, seven stress relief layers may be disposed in the stress relief module. As shown in FIG. 5, a first stress relief layer is disposed at a position corresponding to the flexible organic layer 712, a second stress relief layer is disposed at a position corresponding to the flexible substrate 713 and located on the first stress relief layer, a third stress relief layer is disposed at a position corresponding to the barrier layer 714 and located on the second stress relief layer, a fourth stress relief layer is disposed at a position corresponding to the TFT layer 715 and located on the third stress relief layer, a fifth stress relief layer is disposed at a position corresponding to the OLED layer 711 and located on the fourth stress relief layer, a sixth stress relief layer is disposed at a position corresponding to the encapsulation layer 716 and located on the fifth stress relief layer, and a seventh stress relief layer is disposed at a position corresponding to the flexible stretch organic layer 717 and located on the sixth stress relief layer.

In one embodiment, at least one compensation sub-pixel is disposed in the fifth stress relief layer corresponding to the OLED layer 711, and at least one TFT is disposed in the fourth stress relief layer corresponding to the TFT layer 715, and a control unit controls display of a plurality of sub-pixels and the at least one compensation sub-pixel by controlling the TFT layer 715 and the at least one TFT in the fourth stress relief layer, and an arrangement manner and a display state of the plurality of sub-pixels and the at least one compensation sub-pixel in the OLED layer 711 may be as shown in FIG. 4, and the details are not described herein again. In this embodiment, a material of each layer in the stress relief module may be the same, preferably a shape memory polymer, for example, a styrene or an epoxy polymer.

It should be noted that in the production process of the stretch display screen 70, a whole layer of PDMS may be laid on a glass substrate, and an operation is performed according to the above setting (except a lowermost layer and a uppermost layer). Then, the whole layer of PDMS is laid over the encapsulation layer of each pixel structure and the sixth stress relief layer of each stress relief module. Finally, the stretch display screen 70 is flexibly stripped from the glass substrate. In addition, in the production process of the stretch display screen 70, a display screen having no stress relief region may be prepared firstly, and then the stress relief region is cut by laser, and then the shape memory polymer is filled into each layer of the above stress relief regions. When the shape memory polymer is filled into each layer of the above stress relief regions, the shape memory polymer may be filled layer by layer, or may be filled to the third stress relief layer, the fourth stress relief layer, the fifth stress relief layer, and the uppermost layer in sequence.

A display device according to the present application includes the stretch display screen provided by any one of the above embodiments.

The above is only the preferred embodiments of the present application, and is not intended to limit the scope of the present application. Any modifications, equivalent substitutions, improvements, etc. made within the spirit and principles of this application shall be included in the scope of protection of this application.

What is claimed is:

1. A stretch display screen, comprising:

a display region comprising at least one sub-display region and at least one pixel compensation region which are arranged in a predetermined direction in sequence, and a stretching region;

a detecting unit disposed in the stretching region for acquiring a tensile strength of the stretch display screen in a stretched state; and a pixel compensation control unit receiving a signal of the detecting unit and controlling a light-emitting area of the at least one pixel compensation region to emit light according to the tensile strength, wherein each of the at least one sub-display region and each of the at least one pixel compensation region have same layer structures, the stretching region comprises a stress relief module, and each layer in the stress relief module corresponds to each layer in each of the at least one sub-display region and each of the at least one pixel compensation region one by one.

2. The stretch display screen of claim 1, wherein in the stretched state, the tensile strength of the stretch display screen matches with the light-emitting area of the at least one pixel compensation region, and the greater the tensile strength is, the larger the light-emitting area of the at least one pixel compensation region is.

3. The stretch display screen of claim 2, wherein the detecting unit is au elastic sensor.

4. The stretch display screen of claim 1, wherein the at least one sub-display region and the at least one pixel compensation region are independently controlled.

5. The stretch display screen of claim 1, wherein the at least one pixel compensation region includes a plurality of pixel compensation regions disposed radially around each of the at least one sub-display region, each of the plurality of pixel compensation regions comprises a plurality of compensation pixel units, and the greater the tensile strength of the stretch display screen is, the more of the compensation pixel units that are radially outwardly distributed from the sub-display region emit light.

6. The stretch display screen of claim 1, wherein a ratio of a sum of a light-emitting area of the at least one pixel compensation region to a sum of a light-emitting area of the at least one sub display region is greater than 0, and less than or equal to 0.5.

7. The stretch display screen of claim 1, wherein each of the at least one sub-display region and each of the at least one pixel compensation region respectively comprise at least one pixel unit, each of the at least one pixel unit comprises three sub-pixels of different colors, and an area of an opening of a sub-pixel in each of the at least one sub-display region is same to an area of an opening of a sub-pixel of a same color in each of the at least one pixel compensation region.

8. The stretch display screen of claim 7, wherein the three sub-pixels in each of the at least one pixel unit in the at least one sub-display region are arranged in an isosceles triangle, and a vertical bisector of the isosceles triangle is parallel to the predetermined direction.

9. The stretch display screen of claim 1, wherein the stretching region extends through a substrate, a Thin Film Transistor layer and an Organic Light-Emitting Diode layer of the stretch display screen in a direction orthogonal to the stretch display screen.

10. The stretch display screen of claim 1, wherein each layer of the stretching region is made of a shape memory polymer.

11. The stretch display screen of claim 10, wherein the shape memory polymer is a styrene or an epoxy polymer.

12. The stretch display screen of claim 1, wherein each of the at least one sub-display region comprises at least one predetermined pixel unit, each of the at least one pixel compensation region comprises at least one compensation pixel unit located on one side of each of the at least one predetermined pixel unit deviating from a stretching direction of the stretch display screen, and a distance d between each of the at least one compensation pixel unit and a corresponding predetermined pixel unit is equal to $$\frac{L}{L+D} \times D,$$

L refers to a stretched length of the stretch display screen, and D refers to a spacing of two predetermined pixel units on both sides of the at least one compensation pixel unit in a stretching direction of the stretch display screen.

13. The stretch display screen of claim 12, wherein each of the at least one pixel compensation region comprises a plurality of compensation pixel units, the plurality of compensation pixel units are linearly arranged along the predetermined direction, the at least one sub-display region and the at least one pixel compensation region are independently controlled, and the greater the tensile strength of the stretch display screen is, one of the plurality of compensation pixel units which is further away from the corresponding predetermined pixel unit is selected to emit light instead of the corresponding predetermined pixel unit.

14. A display device, comprising the stretch display screen of claim 1.

* * * * *